US008904612B1

(12) United States Patent
Lin

(10) Patent No.: US 8,904,612 B1
(45) Date of Patent: Dec. 9, 2014

(54) RIVET GUN WITH ALIGNMENT STRUCTURES

(71) Applicant: Yu-Tang Lin, New Taipei (TW)

(72) Inventor: Yu-Tang Lin, New Taipei (TW)

( * ) Notice: Subject to any disclaimer, the term of this patent is extended or adjusted under 35 U.S.C. 154(b) by 2 days.

(21) Appl. No.: 13/943,255

(22) Filed: Jul. 16, 2013

(51) Int. Cl.
*B21J 15/22* (2006.01)
*B21J 15/10* (2006.01)

(52) U.S. Cl.
CPC ..... *B21J 15/105* (2013.01); *B21J 15/22* (2013.01)
USPC ..... 29/243.525; 29/243.523; 72/391.4

(58) Field of Classification Search
CPC ..... B21J 15/20; B21J 15/22; B21J 15/105; B21J 15/043; B21J 15/326
USPC ..... 29/243.523, 243.524, 243.525, 29/243.526; 72/391.4, 391.6
See application file for complete search history.

(56) References Cited

U.S. PATENT DOCUMENTS 8,365,375 B2 * 2/2013 Lin ..... 29/243.525
8,468,669 B1 * 6/2013 Lin ..... 29/243.525

* cited by examiner

*Primary Examiner* — David B Jones
(74) *Attorney, Agent, or Firm* — Lerner, David, Littenberg, Krumholz & Mentlik, LLP

(57) ABSTRACT

A rivet gun has a barrel, a handle, an annular flange, a pneumatic cylinder and a piston assembly. The handle protrudes downward from the barrel. The annular flange protrudes radially from the bottom end of the handle and has a bottom surface and a rotational angle alignment slot defined eccentrically in the bottom surface. The pneumatic cylinder is mounted under the handle and the annular flange and has a body and a top cover mounted on a top opening of the body and having a rotational angle alignment element mounted eccentrically on a top of the top cover and detachably engaging the rotational angle alignment slot of the annular flange. The piston assembly is mounted in the pneumatic cylinder. The rotational angle alignment slot and the rotational angle alignment element are both at least partially exposed to be visually observed from an appearance of the fully assembled rivet gun.

10 Claims, 6 Drawing Sheets

RIVET GUN WITH ALIGNMENT STRUCTURES

BACKGROUND OF THE INVENTION

1. Field of the Invention

The present invention relates to a rivet gun, and more particularly to a rivet gun with alignment structures that include alignment elements to ensure that a handle and a pneumatic cylinder are aligned with each other at a correct rotational angle relative to an axis of the handle for quick and precise fabrication.

2. Description of Related Art

A conventional rivet gun, as disclosed by Taiwan utility model patent No. M400369, is used to rivet two boards such that the boards are securely mounted together by rivets. A rivet has a cap and a core pin. The cap is T-shaped and has an enlarged end and a mounting end. The core pin is mounted longitudinally through and protrudes out of the cap and has two ends and a ball formed on one end and adjacent to the mounting end of the cap.

A conventional rivet gun comprises a barrel, a handle, a trigger, a pin collector and a pneumatic cylinder.

The barrel has a front end, a rear end and a vise assembly that may vise and pull a core pin of a rivet on the front end into the barrel. The handle is mounted perpendicularly on the barrel and has air passageways. The collector is a jar mounted on the rear end of the barrel to collect the ejected core pins. The pneumatic cylinder is mounted movably under the handle and capable of activating the vise assembly through pneumatic and hydraulic means. Furthermore, the pneumatic cylinder may be connected to a high-pressure air source such as an air bottle to implement the ejection of the core pin.

When the rivet gun is used to rivet two pieces such as boards or plates together, a rivet is mounted through the pieces. The enlarged end of the cap of the rivet abuts an inside piece, and the front end of the barrel of the rivet gun abuts the enlarged end. The trigger is pulled to activate the vise assembly to pull a core pin on the cap into the barrel. The ball on the core pin longitudinally compresses and radially expands the mounting end of the cap into T-shape so that the expanded mounting end hooks on an outside piece to complete the riveting process. Then, the air output by the high-pressure air source flows through the barrel from the front end to the rear end and sucks the broken core pin vised by the vise assembly backward into the collector.

The handle has a flange radially formed on a bottom of the handle and a hydraulic tube mounted in the handle and having an outer thread. The pneumatic cylinder has a hollow and annular body and a top cover screwed on a top end of the annular body. The top cover presses against the flange of the handle and has a mounting hole defined therethrough such that the hydraulic tube extends through the mounting hole. A nut is screwed on the outer thread of the hydraulic tube to clamp and fasten the top cover between the flange of the handle and the nut. However, no alignment structures exist among the flange of the handle and the top cover of the pneumatic cylinder. When assembling the rivet gun, a user needs to observe through naked eyes and ensure that corresponding through holes and components on the handle and the pneumatic cylinder are aligned with one another at a correct rotational angle relative to an axis of the handle so that the handle may be pressed downward against and mounted correctly on the top cover of the pneumatic cylinder. These holes and components are hidden and cannot be observed when the handle completely presses against the top cover so that the user cannot be fully assured whether these holes and components are aligned at the correct rotational angle. Therefore, the user frequently disassembles the rivet gun and repeats assembling steps due to incorrect fabrication of the rive gun.

To overcome the shortcomings, the present invention provides a rivet gun with alignment structures to mitigate or obviate the aforementioned problems.

SUMMARY OF THE INVENTION

The main objective of the invention is to provide a rivet gun with alignment structures that include alignment elements to ensure that a handle and a pneumatic cylinder are aligned with each other at a correct rotational angle relative to an axis of the handle for quick and precise fabrication.

A rivet gun in accordance with the present invention has a barrel, a handle, an annular flange, a pneumatic cylinder and a piston assembly. The handle protrudes downward from the barrel. The annular flange protrudes radially from a bottom end of the handle and has a bottom surface and a rotational angle alignment slot defined eccentrically in the bottom surface. The pneumatic cylinder is mounted under the handle and the annular flange and has a body and a top cover mounted on a top opening of the body and having a rotational angle alignment element mounted eccentrically on a top of the top cover and detachably engaging the rotational angle alignment slot of the annular flange. The piston assembly is mounted in the pneumatic cylinder. The rotational angle alignment slot and the rotational angle alignment element are both at least partially exposed to be visually observed from an appearance of the fully assembled rivet gun.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
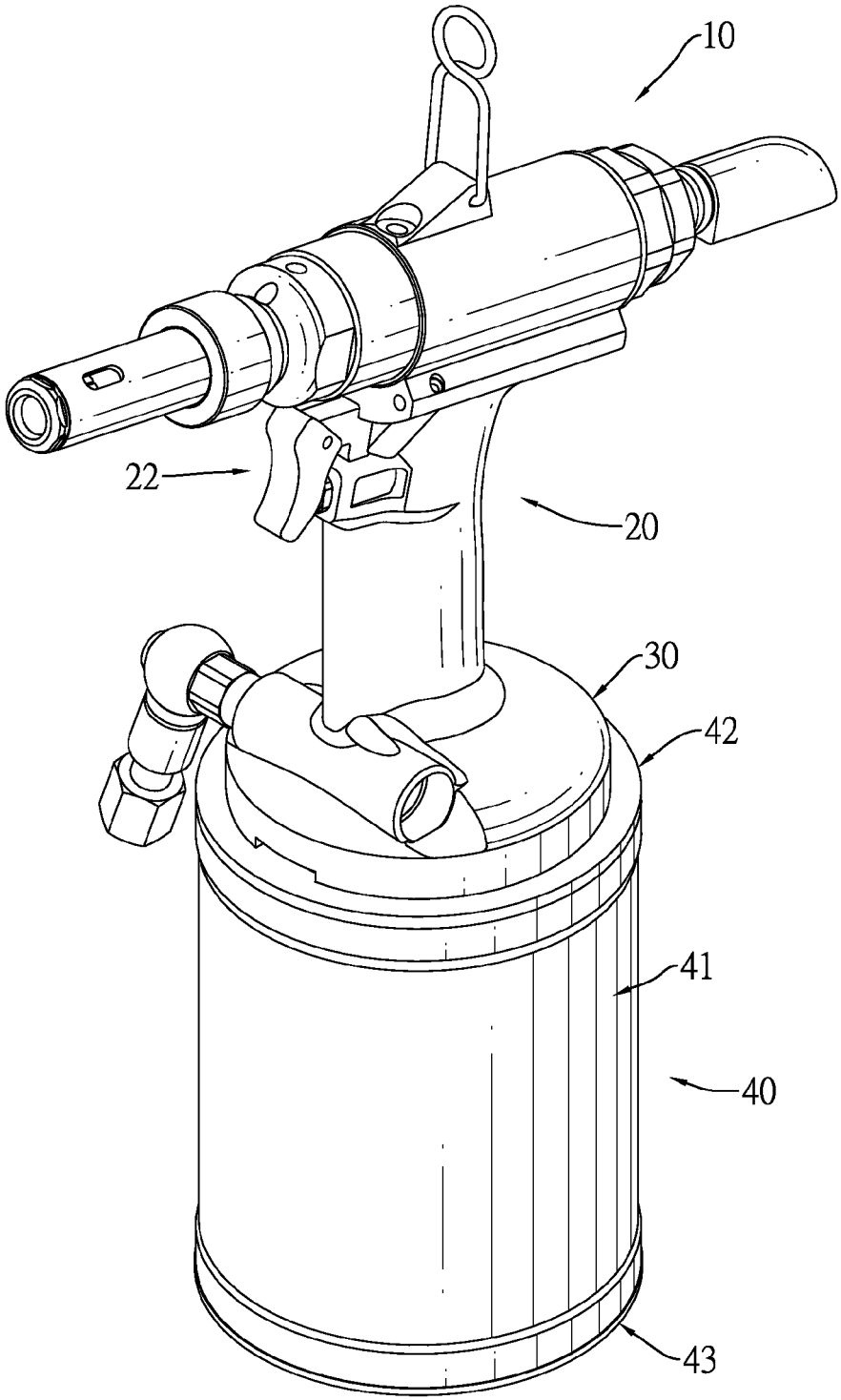
FIG. 1 is a perspective view of a rivet gun with alignment structures in accordance with the present invention.
Figure 2:
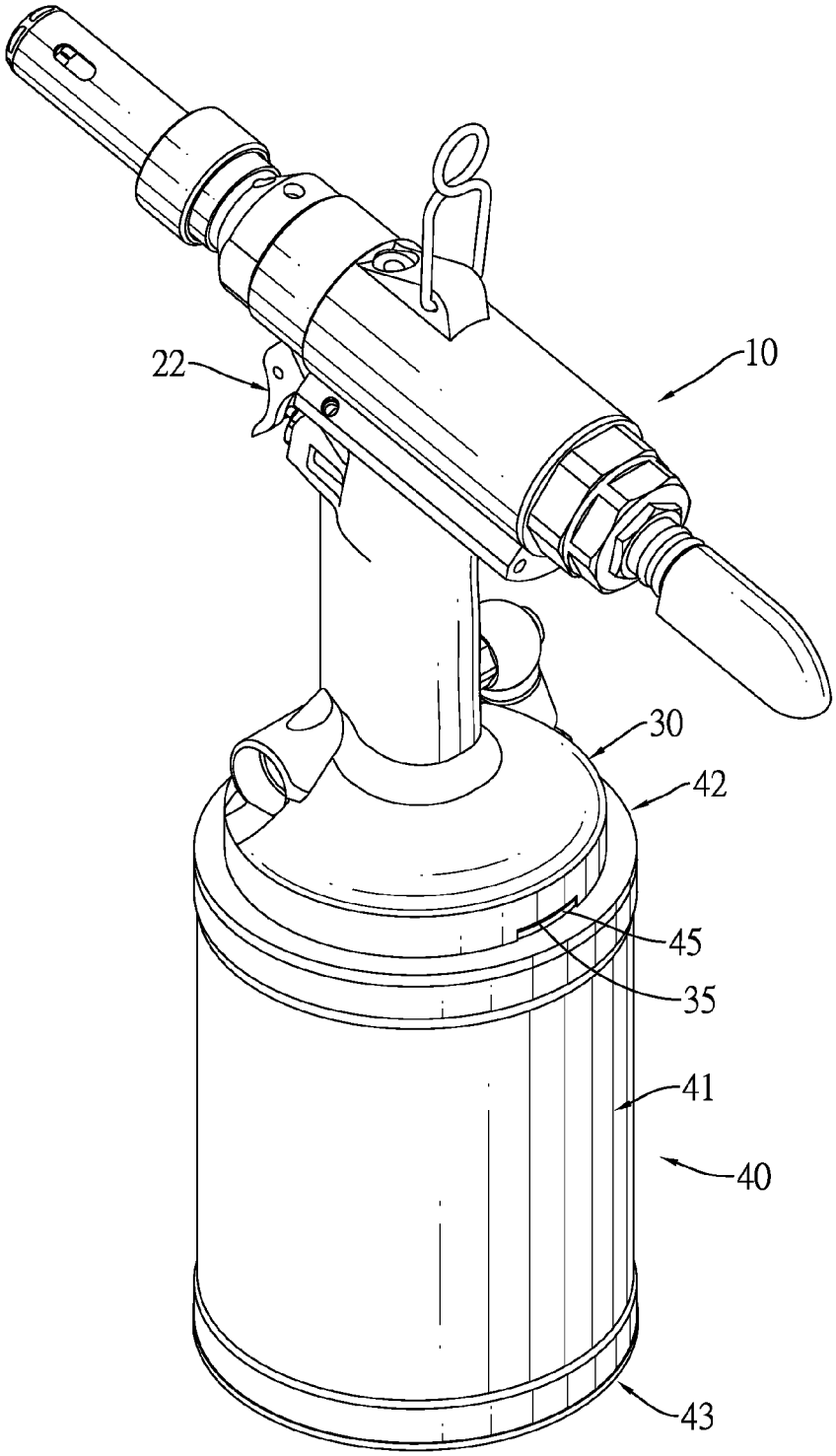
FIG. 2 is another perspective view of the rivet gun in FIG. 1.
Figure 3:
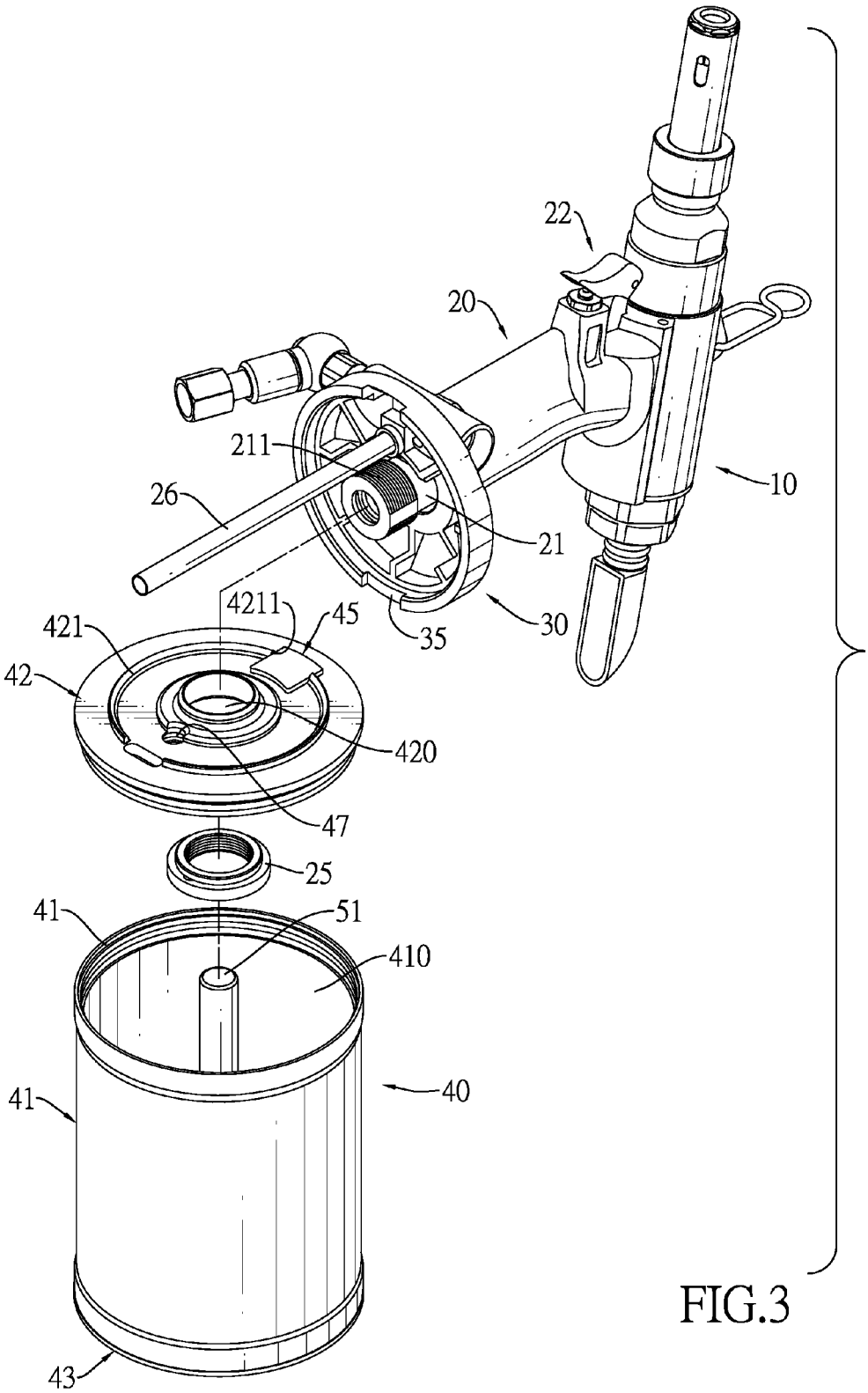
FIG. 3 is a partially exploded perspective view of the rivet gun in FIG. 1.

With reference to FIGS. 1 to 3, a rivet gun with alignment structures in accordance with the present invention comprises a barrel 10, a handle 20, an annular flange 30, a pneumatic cylinder 40 and a piston assembly 50.

The barrel 10 has a vise assembly 11 mounted therein. The vise assembly 11 is capable of vising and pulling a core pin of a rivet into the barrel.

Figure 5:
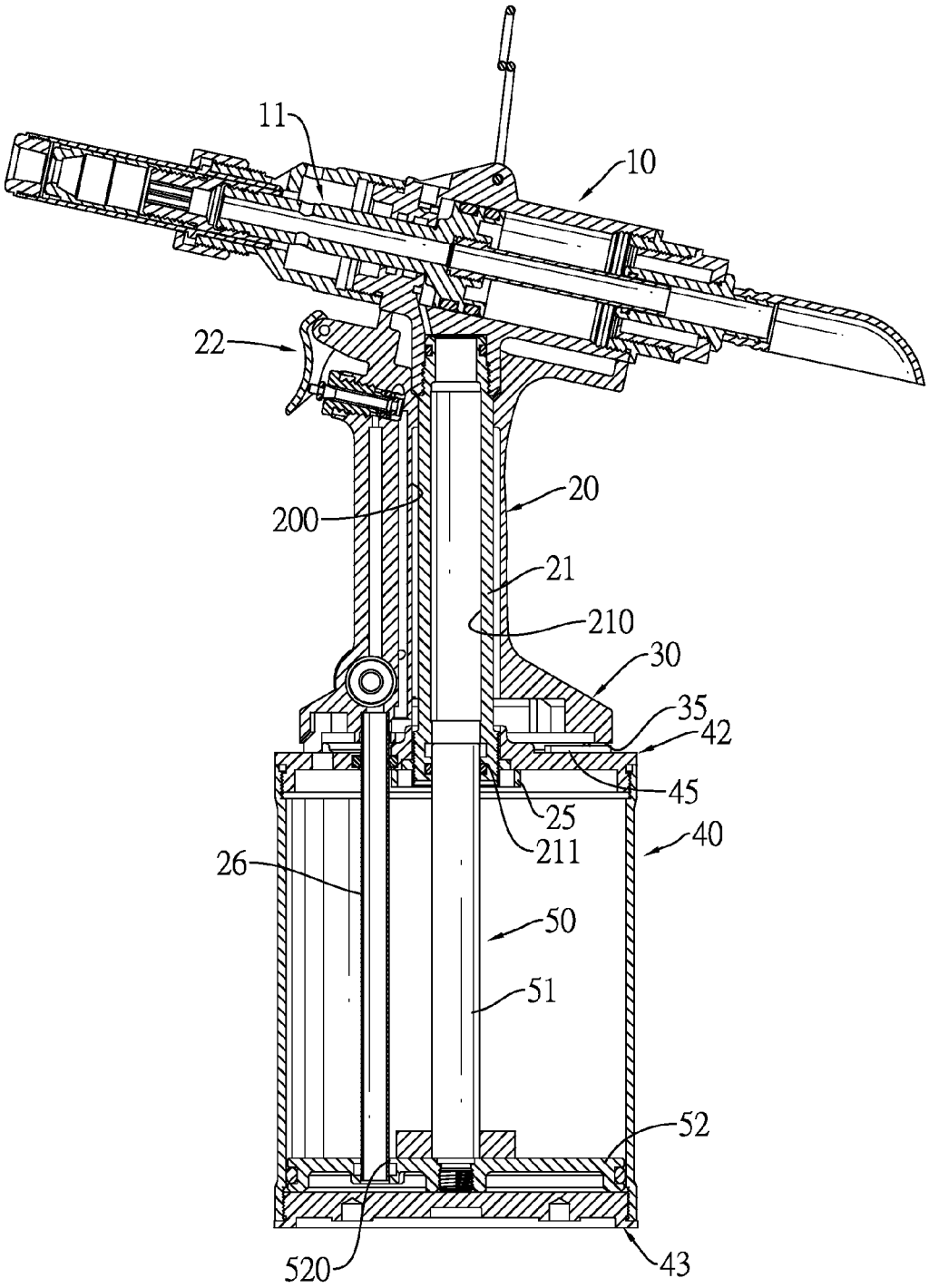
FIG. 5 is a cross sectional side view of the rivet gun in FIG. 1.

With further reference to FIG. 5, the handle 20 is formed on and protrudes downward from the barrel 10 and has an internal space 200, a hydraulic tube 21, a nut 25, an air tube and a trigger assembly 22. The internal space 200 is defined in the handle 20. The hydraulic tube 21 is mounted in the internal space 200 and has a central hole 210 and an outer thread 211.

The central hole 210 is defined through the hydraulic tube 21. The outer thread 211 is formed on a bottom end of the hydraulic tube 21. The nut 25 is screwed on the outer thread 211 of the hydraulic tube 21. The air tube 26 is mounted on a bottom end of the handle 20. The trigger assembly 22 is mounted on the handle 20 and is connected to the vise assembly 11 to activate the vise assembly 11 for pulling a rivet.

The annular flange 30 is formed on and protrudes radially from the bottom end of the handle 20 and has a bottom surface and a rotational angle alignment slot 35 defined eccentrically in the bottom surface.

The pneumatic cylinder 40 is mounted under the handle 20 and the annular flange 30 and has a body 41, a top cover 42 and a bottom seat 43.

Figure 4:
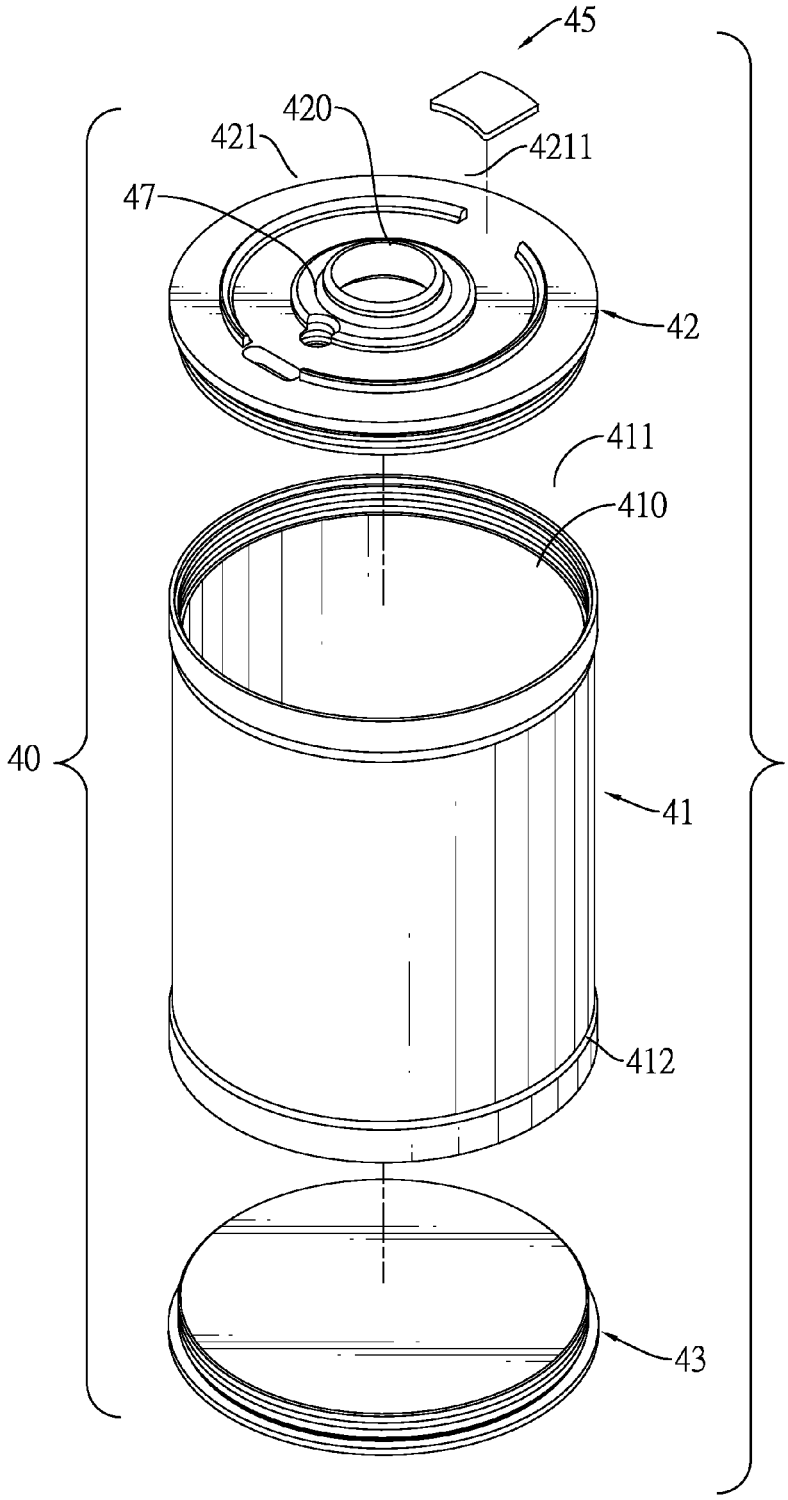
FIG. 4 is an exploded perspective view of a pneumatic cylinder in FIG. 1.
Figure 6:
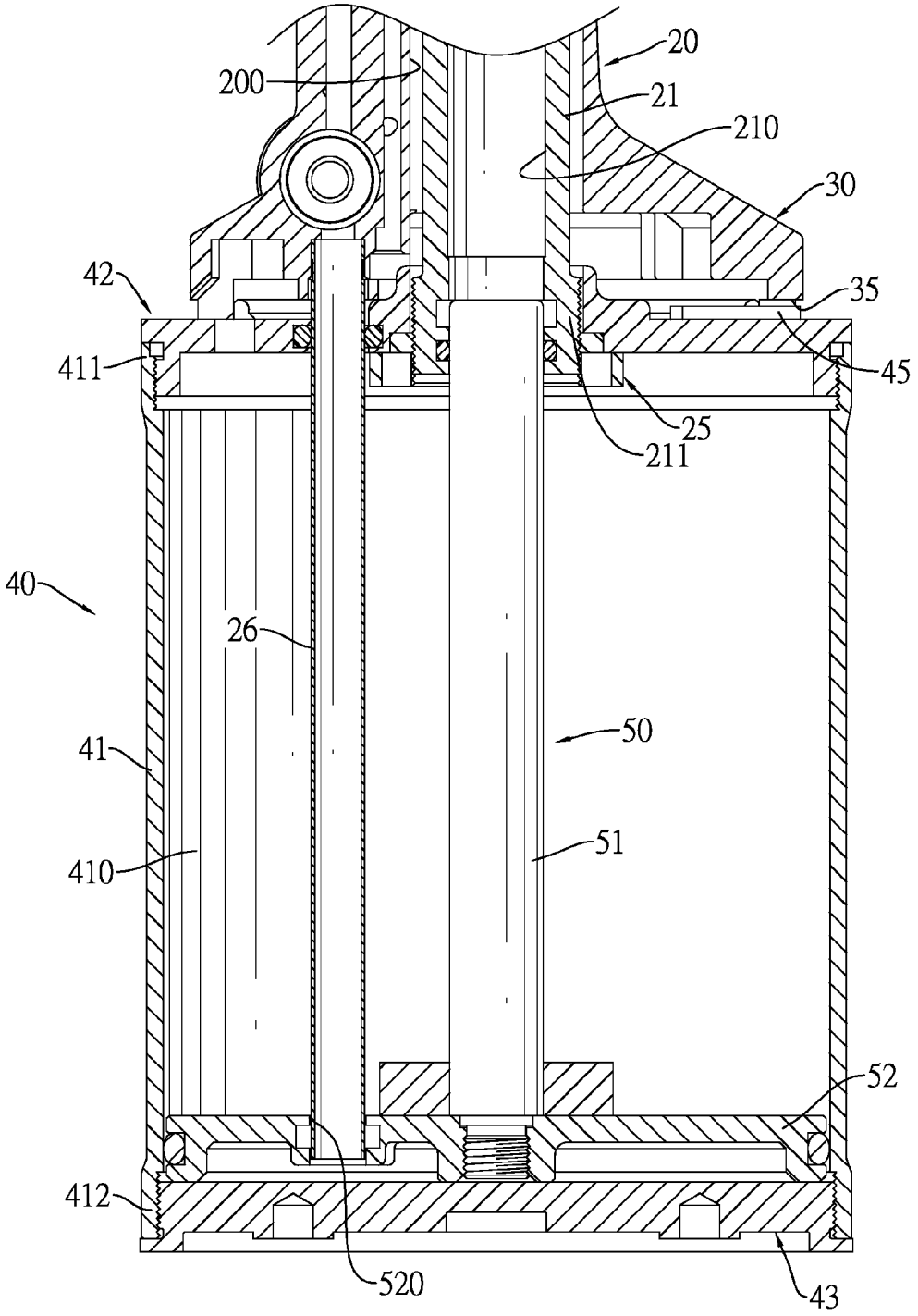
FIG. 6 is an enlarged cross sectional side view of the rivet gun in FIG. 5.

With further reference to FIGS. 4 to 6, the body 41 has a cavity 410, a top opening 411 and a bottom opening 412. The cavity 410 is defined through the body 41 and receives the air tube 26. The top opening 411 communicates with the cavity 410. The bottom opening 412 communicates with the cavity 410.

The top cover 42 is mounted on the top opening 411 of the body 41, is mounted between and clamped by the annular flange 30 and the nut 25 and has a mounting hole 420 and a rotational angle alignment element 45. The mounting hole 420 is defined centrally through the top cover 42 such that the hydraulic tube 21 extends through the mounting hole 420. The rotational angle alignment element 45 may be a plate, is mounted eccentrically on a top of the top cover 42 and detachably engages the rotational angle alignment slot 35 of the annular flange 30. The rotational angle alignment slot 35 and the rotational angle alignment element 45 are both at least partially exposed and therefore allow a user to visually observe the rotational angle alignment slot 35 and the rotational angle alignment element 45 from an appearance of the fully assembled rivet gun, as shown in FIG. 2.

Furthermore, the rotational angle alignment element 45 and the top cover 42 of the pneumatic cylinder 40 may be two separate members or may be formed integrally into one piece. Moreover, the top cover 42 may further have an annular positioning rib 421 formed on the top of the top cover 42 and pressing against an inner surface of the annular flange 30 to prevent the handle 20 from shifting on the top cover 42. The annular positioning rib 421 has a mounting recess 4211 defined in the annular positioning rib 421 and receiving the rotational angle alignment element 45. Furthermore, the top cover 42 has a mounting orifice 47 defined through the top cover 42 such that the air tube 26 extends through the mounting orifice 47.

The bottom seat 43 is mounted on the bottom opening 412 of the body 41.

The piston assembly 50 is mounted in the cavity 410 of the pneumatic cylinder 40, is connected to the hydraulic tube 21 and has a piston 51 and a head 52. The piston 51 is mounted slidably in the central hole 210 of the hydraulic tube 21. The head 52 is mounted securely on a bottom end of the piston 51 and is mounted slidably in the cavity 410 of the body 41 to divide the cavity 410 into a top chamber and a bottom chamber. The head 52 has an assembling hole 520 defined through the head 52 such that the air tube 26 extends through the assembling hole 520.

When assembling the handle 20 and the pneumatic cylinder 40, a user can visually observe locations of the exposed rotational angle alignment slot 35 of the annular flange 30 and the rotational angle alignment element 45 on the top cover 42 in advance. The user aligns and engages the rotational angle alignment slot 35 and the rotational angle alignment element 45 so that the barrel 10 and the handle 20 are correctly assembled on the pneumatic cylinder 40. During assembling of the handle 20 and the pneumatic cylinder 40, the rotational angle alignment slot 35 and the rotational angle alignment element 45 are always exposed and can be observed through naked eyes so that the user can easily fabricate the rivet gun without disassembling the rivet gun and repeating fabrication steps.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A rivet gun comprising:

a barrel having a vise assembly mounted therein;

a handle formed on and protruding downward from the barrel and having an internal space defined in the handle; and a hydraulic tube mounted in the internal space;

an annular flange formed on and protruding radially from a bottom end of the handle and having a bottom surface and a rotational angle alignment slot defined eccentrically in the bottom surface;

a pneumatic cylinder mounted under the handle and the annular flange and having a body having a cavity defined through the body and a top opening communicating with the cavity; and a top cover mounted on the top opening of the body and having a mounting hole defined centrally through the top cover such that the hydraulic tube extends through the mounting hole; and a rotational angle alignment element mounted eccentrically on a top of the top cover and detachably engaging the rotational angle alignment slot of the annular flange; and a piston assembly mounted in the cavity of the pneumatic cylinder and connected to the hydraulic tube;

wherein the rotational angle alignment slot and the rotational angle alignment element are both at least partially exposed to be visually observed from an appearance of the fully assembled rivet gun.

2. The rivet gun as claimed in claim 1, wherein the top cover further has an annular positioning rib formed on the top of the top cover, pressing against an inner surface of the annular flange and having a mounting recess defined in the annular positioning rib and receiving the rotational angle alignment element.

3. The rivet gun as claimed in claim 2, wherein the piston assembly has a piston mounted slidably in a central hole of the hydraulic tube; and a head mounted securely on a bottom end of the piston, mounted slidably in the cavity of the body to divide the cavity into a top chamber and a bottom chamber, and having an assembling hole defined through the head such that the air tube extends through the assembling hole.

4. The rivet gun as claimed in claim 3, wherein the handle further has an air tube mounted on the bottom end of the handle and extending into the cavity of the pneumatic cylinder;

the top cover has a mounting orifice defined through the top cover such that the air tube extends through the mounting orifice; and the head has an assembling hole defined through the head and such that the air tube extends through the assembling hole.

5. The rivet gun as claimed in claim 4, wherein the body further has a bottom opening communicating with the cavity, and a bottom seat is mounted on the bottom opening of the body.

6. The rivet gun as claimed in claim 5, wherein the hydraulic tube has an outer thread formed on a bottom end of the hydraulic tube;

a nut is screwed on the outer thread of the hydraulic tube; and the top cover is mounted between and clamped by the annular flange and the nut.

7. The rivet gun as claimed in claim 1, wherein the rotational angle alignment element and the top cover of the pneumatic cylinder are two separate members.

8. The rivet gun as claimed in claim 6, wherein the rotational angle alignment element and the top cover of the pneumatic cylinder are two separate members.

9. The rivet gun as claimed in claim 1, wherein the rotational angle alignment element and the top cover of the pneumatic cylinder are formed integrally into one piece.

10. The rivet gun as claimed in claim 6, wherein the rotational angle alignment element and the top cover of the pneumatic cylinder are formed integrally into one piece.

* * * * *